US009518522B2

(12) United States Patent
Barber et al.

(10) Patent No.: US 9,518,522 B2
(45) Date of Patent: Dec. 13, 2016

(54) UAV ENGINE EXHAUST GAS TEMPERATURE CONTROL

(71) Applicant: Orbital Australia Pty Ltd, Balcatta (AU)

(72) Inventors: Terran Ambrose Barber, Mount Hawthorn (AU); Geoffrey Paul Cathcart, Mount Lawley (AU); John Howard Tubb, Bedfordale (AU); Callan Murray Bleechmore, Swanbourne (AU)

(73) Assignee: ORBITAL AUSTRALIA PTY LTD., Balcatta (AU)

( * ) Notice: Subject to any disclaimer, the term of this patent is extended or adjusted under 35 U.S.C. 154(b) by 50 days.

(21) Appl. No.: 14/406,517

(22) PCT Filed: Jun. 7, 2013

(86) PCT No.: PCT/AU2013/000606

§ 371 (c)(1),
(2) Date: Dec. 8, 2014

(87) PCT Pub. No.: WO2013/181710

PCT Pub. Date: Dec. 12, 2013

(65) Prior Publication Data

US 2015/0176515 A1 Jun. 25, 2015

Related U.S. Application Data

(60) Provisional application No. 61/665,311, filed on Jun. 28, 2012.

(30) Foreign Application Priority Data

Jun. 8, 2012 (AU) ..... 2012902408

(51) Int. Cl.
*F02D 41/04* (2006.01)
*F02D 41/14* (2006.01)
(Continued)

(52) U.S. Cl.
CPC ..... *F02D 41/1475* (2013.01); *F02D 9/02* (2013.01); *F02D 41/021* (2013.01);
(Continued)

(58) Field of Classification Search
CPC F02D 41/1475; F02D 41/021; F02D 41/1446; F02D 41/3017; F02D 41/3064; F02D 41/402; F02D 41/0025; F02D 9/02; F02D 2200/602; F02D 2200/101
(Continued)

(56) References Cited

U.S. PATENT DOCUMENTS 5,265,581 A * 11/1993 Nagaishi ..... F02D 41/2454 123/675
5,278,762 A * 1/1994 Kawamura ..... F02D 37/02 123/406.47
(Continued)

FOREIGN PATENT DOCUMENTS

WO WO 2012/012511 1/2012

*Primary Examiner* — Hai Huynh
(74) *Attorney, Agent, or Firm* — Cislo & Thomas, LLP

(57) ABSTRACT

For an unmanned aerial vehicle (UAV) engine, an exhaust gas temperature control method is provided during operation of the UAV engine to protect exhaust components, particularly lightweight aluminium components, from overheating or melting. The engine is operated with a leaner than stoichiometric air-fuel ratio during low or part engine load conditions. Transition to a richer than stoichiometric air-fuel ratio is made as engine load or engine speed, or both engine load and engine speed, increase(s). At sufficiently low engine loads, the air-fuel ratio can be maintained in a lean ratio region. As demand on the engine causes engine speed
(Continued)

and load to increase, the amount of excess air available reduces. The ability to operate lean is reduced and the exhaust gas temperature increases as the mixture becomes richer. In order to obtain the demand power, and keep exhaust temperature below an exhaust gas temperature limit, the air-fuel ratio is transitioned to a richer than stoichiometric region. As engine load and speed demand decreases, the air-fuel ratio can be transitioned back to a leaner region.

19 Claims, 1 Drawing Sheet

(51) Int. Cl.

| | |
|---|---|
| ***F02D 41/02*** | (2006.01) |
| ***F02D 9/02*** | (2006.01) |
| *F02D 41/30* | (2006.01) |
| *F02D 41/00* | (2006.01) |

(52) U.S. Cl.
CPC ..... *F02D 41/1446* (2013.01); *F02D 41/0025* (2013.01); *F02D 41/3017* (2013.01); *F02D 2200/101* (2013.01); *F02D 2200/602* (2013.01)

(58) Field of Classification Search
USPC ..... 123/299, 300, 431, 575, 577, 578, 672,123/676, 681, 687, 443, 436; 701/103, 110; 60/276, 285
See application file for complete search history.

(56) References Cited

U.S. PATENT DOCUMENTS

| | | | | |
|---|---|---|---|---|
| 8,112,218 | B2 * | 2/2012 | Russ | F02D 41/0007 123/406.45 |
| 2013/0245920 | A1 * | 9/2013 | Vos | F02D 41/1443 701/104 |
| 2014/0157760 | A1 * | 6/2014 | Tufail | F01N 3/208 60/274 |

* cited by examiner

UAV ENGINE EXHAUST GAS TEMPERATURE CONTROL

This patent application is a national phase entry of PCT Application No. PCT/AU2013/000606, filed Jun. 7, 2013, which claims priority to Australian Application Number 2012902408, filed Jun. 8, 2012, and U.S. Provisional Application Number 61/665,311, filed Jun. 28, 2012, which applications are incorporated in their entirety here by this reference.

FIELD OF THE INVENTION

The present invention relates to the control of exhaust gas temperature in unmanned aerial vehicles (UAVs).

BACKGROUND TO THE INVENTION

UAVs have increasing application for defence and civil applications and are used for many purposes including surveillance, surveying, exploration and security.

Various designs of UAV are in current use. Some are of ducted fan type in which a rotary fan, propeller (or 'prop') assembly, driven by an engine, is enclosed within a shroud. Others are of fixed wing type or helicopter type with un-shrouded propeller or rotor, and still others are of hybrid type such as described in U.S. Pat. No. 6,270,038 assigned to Sikorsky Aircraft Corporation.

UAVs are constructed to be light and powerful for their size in order to give desired range, flight duration and air speed performance. The engine and its associated equipment are typically constructed of metal. Lightweight metals are preferred in order to reduce overall weight of the UAV and thereby achieve or maximise the aforementioned desired performance characteristics. Lightweight materials allow for more and/or improved noise reduction features/components on the UAV for a given total UAV mass, which help to make the UAV as quiet as possible. This is particularly beneficial for surveillance or security operations.

However, lightweight metals are either expensive, such as titanium, or have relatively low heat resistance characteristics, such as aluminium, and often require cooling mechanisms to prevent them melting. Aluminium is typically preferred because it is relatively cheap and capable of being moulded, cast or machined into suitable components. However, aluminium has a relatively low melting point. This is not a problem for most metal components on a UAV. But a specific problem arises when aluminium is used for or as part of the engine exhaust outlet, such as the exhaust manifold. Exhaust gases from the engine of a UAV under certain operating conditions can be sufficiently hot to melt an aluminium exhaust outlet.

This is a particular problem when demanding full power from the UAV, such as when full speed, increased climb rate or heavy payload lift is required. Ducted air cooling over the exhaust outlet can help to cool the outlet sufficiently for some engine operating conditions.

A known strategy for maintaining UAV exhaust temperature below a certain temperature limit is to run the engine air-fuel mixture richer than stoichiometric. Under such operating conditions the excess fuel helps to cool the exhaust gases. This strategy is often adopted partly because there are no emissions control regulations for UAV small engines.

However, using a rich air-fuel ratio uses excess fuel and does not generate more power; rather, it penalises fuel economy and thereby limits range and performance of the UAV. Rich air-fuel ratios also degrade engine stability through potential rich misfire which can occur.

On a UAV, stability is important due to vibration sensitivity of certain payloads, such a cameras mounted to the air frame. Improved fuel consumption would also give greater range or reduce the fuel payload to allow for higher airspeed or increased strategic payload (e.g. cameras, batteries or communications equipment).

It is important to note that miniature aircraft (such as model aircraft) engines typically run on a rich fuel-air mixture. This is primarily for engine durability and also often due to the lack of precise fuel-air ratio control on such small engines. Also, given the very small amounts of fuel burnt during a typical miniature aircraft flight (duration not being relatively very long in the air), fuel economy is of little importance. Hence running rich and the associated poor fuel economy is not perceived as a problem but a durability benefit. For these reasons, running a miniature engine lean would not typically be perceived as a preferred mode of operation for such engines.

One known prior art document, US 2003/0060962, directed to miniature aircraft discusses microprocessor controlled fuel-air ratios selected from a look-up table. However, other than suggesting selecting suitable fuel-air ratios automatically without controller (user) input, the document is silent about control of exhaust gas temperature to prevent damage to components, or even any control of exhaust gas temperature for any reason.

Attempts to run a leaner mixture in certain aircraft engines have focused on the need to target (reach) a peak exhaust gas temperature, typically around 620° C. to 720° C. For example, WO 2012/012511 discloses a fuelling strategy that specifically sets a target exhaust gas temperature, and modifies the air-fuel ratio, ignition timing and/or fuel injection timing to reach that target temperature. A feedback loop is used to help maintain the desired target temperature.

Fuelling strategies have been tried which adopt a closed loop system utilising feedback to control fuel-air mixture. Such closed loop strategies typically limit the lean burn mixture to prevent going over lean and to return the fuel-air ratio to a richer mixture when required.

One known prior art document, U.S. Pat. No. 7,658,184, focuses on the intersection between rich exhaust gas temperature signals and lean exhaust gas temperature signals to target a peak fuel-air ratio for the cylinder head assembly to maintain an optimal fuel economy. U.S. Pat. No. 7,658,184 does not however consider or discuss the problem of overheating lightweight exhaust components or a fuelling strategy to control exhaust gas temperature to prevent damage to such exhaust components.

It has been realised in the present invention that there are practical benefits in reducing peak exhaust gas temperature well below these limits in order to protect the integrity of lightweight aluminium based exhaust components. Keeping the peak exhaust to around 550° C. or less helps to achieve this goal It is known that some such strategies in the prior art simply adjust the fuel-air ratio richer or leaner to maintain a desired emissions requirement or for fuel or engine efficiency, and mainly to compensate for altitude or atmospheric conditions, such as to control engine speed to maintain altitude or airspeed.

Many gas fuelled aircraft engines are known to operate in the region lean of a stoichiometric air fuel ratio, and in some cases tend to run lean overall. In such engines there is no need to operate with a richer than stoichiometric fuel-air ratio since the mixing of air and gaseous fuel is better compared to gasoline fuelled engines. Hence the benefits of richening in a gasoline engine for power and then component protection benefits are not so relevant. Accordingly, it would not be expected to control exhaust gas temperature by way of richening in such engines to prevent damage to the exhaust components.

For example, published patent application US 2009/0076709 discloses a strategy for controlling gas fuelled engines. The strategy attempts to control engine speed by varying the fuel-air ration in order to maintain a target engine speed. Exhaust gas temperature is used as an input to try to maintain the required engine speed. This document teaches the opposite of the present invention. This document does not envisage controlling fuel-air mixture in order to manage exhaust gas temperature in order to protect exhaust components from melting.

None of the aforementioned known fuelling strategies control exhaust gas temperature to protect the exhaust system components.

The present invention has been conceived in light of the aforementioned problems. It has been found desirable to provide improved combustion management in a UAV engine to control exhaust gas temperature and thereby help preserve the exhaust gas outlet from heat damage and to maintain engine stability.

Furthermore, it has been found desirable to limit exhaust gas temperature to a specific threshold value to protect the integrity of the exhaust gas system components, and particularly to prevent higher exhaust gas temperatures being reached which may otherwise melt the exhaust components.

SUMMARY OF THE INVENTION

For an unmanned aerial vehicle (UAV) engine, the present invention provides in one aspect an exhaust gas temperature control method during operation of the UAV engine, the method including operating the engine with a leaner than stoichiometric air-fuel ratio during low or part engine load conditions, and transitioning to a richer than stoichiometric air-fuel ratio as engine load or engine speed, or both engine load and engine speed, increase.

The present invention advantageously reduces overall UAV engine fuel consumption, which improves UAV range and/or endurance. The present invention also beneficially alleviates the problem of hot exhaust gases overheating or melting a lightweight exhaust gas outlet, such as an exhaust manifold formed of aluminium or other lightweight material.

Advantageously, excess air available at part load (accessed by opening the throttle) allows lean operation, and the lower exhaust gas temperature that results. As engine load increases, there is less excess air available (the throttle is already open) thus it is eventually necessary to switch to richer operation.

One or more embodiments of the present invention may utilise direct injection (DI). Direct injection may include dual fluid injection, such as air assisted DI. Such fuel injection may include fuelling the UAV engine on heavy fuel, such as jet propellant (JP) e.g. JP-5 or JP-8.

The control method may include, when operating the engine at the leaner than stoichiometric air-fuel ratio, delaying injection of a fuel charge into at least one combustion chamber, the delayed fuel charge including an air-fuel ratio portion at or close to stoichiometric. This ensures the delivered fuel is able to be ignited even though the overall fuel to air ratio in the delivered fuel charge is leaner than stoichiometric.

A stratified fuel injection strategy may be used, whereby the delayed fuel charge forms part of a stratified delivery into the combustion chamber(s). Stratified charge importantly allows a stoichiometric or near stoichiometric fuel charge to be delivered to help initiate combustion in what is an overall lean fuel fuel-air combustion.

The step of transitioning from leaner than stoichiometric air-fuel ratio to richer than stoichiometric air-fuel ratio may be based on measured, demanded or required engine speed or engine load or both engine speed and engine load. For example, an operator may demand increased engine speed by operating the throttle. Such demand may be used to determine the required air-fuel ratio to achieve the demanded or required engine speed.

Control of exhaust temperature to prevent overheating or heat damage of exhaust outlets (e.g. exhaust manifolds) of UAVs may be achieved by relying on air cooling over an exhaust manifold and/or exhaust outlet at part or low engine load when operating the engine at the lean air-fuel ratio, and, at increased or high engine load, transitioning the air fuel ratio to the richer than stoichiometric ratio to maintain an exhaust gas temperature below a required temperature threshold. This beneficially makes use of air cooling around the engine which is sufficient when exhaust gas temperatures are below an acceptable level. As engine load increases and exhaust gas temperature increases such that air cooling alone is not sufficient to keep the temperature of the exhaust down and there is a risk of damage to the exhaust gas outlet, transitioning to a richer air-fuel ratio is used to effect further cooling of the exhaust gas emitted from the engine.

It will be appreciated that a combination of air cooling and increased richness of fuel-air ratio may be employed to alleviate durability issues (and specifically melting) with exhaust manifolds as applied to UAV engines. The reliance on a richer air-fuel ratio to natural air cooling may be increased dependent upon engine speed or load demand or actual speed/load, such as using a measurement of air cooling or air flow and/or a measure of demand or actual speed/load. A look up table, map, algorithm, such as in an electronic control unit or engine management system may be employed.

The method may include determining engine load demand, and transitioning air fuel ratio based on that demand. Engine load demand may be determined from one or more operator inputs, such as by remote control. The one or more operator inputs may include an indication or selection of throttle position or engine speed request.

An engine management control system may be provided. This may be used to effect the transition from the leaner to the richer air fuel ratios.

Effecting the transition between leaner than stoichiometric and richer than stoichiometric air fuel ratios may be based on allowed or expected exhaust gas temperature (such as a threshold or predetermined value) over a predefined range or ranges of engine speed or engine load, or both engine speed and engine load.

A look up table or algorithm using engine speed or engine load demand may be used to determine a required said air-fuel ratio to maintain the exhaust gas temperature below a desired value or within a desired temperature range.

A temperature value may be determined that relates to or is a measure of exhaust gas temperature, and that temperature may be used in determining transition of the air-fuel ratio towards a richer ratio to reduce exhaust gas temperature, maintain exhaust gas temperature at a desired level or slow down the rate of increase of exhaust gas temperature.

One or more embodiments of the present invention may control exhaust gas temperature to not exceed a threshold temperature by richening the air-fuel ratio. Once a desired engine temperature is reached or not exceeded, the air-fuel ratio may be maintained. Air-fuel ratio may be varied as a function of exhaust gas temperature, such as by a feedback whereby as exhaust gas temperature reduces with richening air-fuel ratio, the rate of increase in air-fuel ratio may be reduced or stopped to maintain the exhaust gas temperature at a desired level or below a threshold value or within a required band of air-fuel ratio.

A further aspect of the present invention includes a UAV engine controlled according to one or more forms of the aforementioned method.

It should be appreciated that the ability to burn heavy fuel in a two stroke direct injection (2S DI) spark ignited UAV engine has not previously been achieved in the known prior art. One or more forms of the present invention achieves this benefit.

The need for lower exhaust temperature limits to allow aluminium exhaust components to be utilised for weight saving benefits on a UAV without the aluminium melting is a problem that one or more forms of the present invention address.

The ability to run a UAV engine on JP5/JP8 rated fuel is also a valuable benefit for a 2S UAV engine design.

Hence, application of the present invention in UAV applications can deliver both fuel economy and lower exhaust gas temperatures to avoid melting components of the exhaust system.

It will be appreciated that leaner and/or stratified charge running in a direct injection two-fluid system typically means hotter exhaust gas temps. Thus, a specific strategy/calibration to control the exhaust gas temperatures in accordance with the present invention is considered highly beneficial. Fuel economy can be controlled, heavier fuels can be burnt and lightweight aluminium exhaust components can be prevented from melting by controlling the exhaust gas temperatures to below a critical level.

DESCRIPTION OF PREFERRED EMBODIMENT

Figure 1:
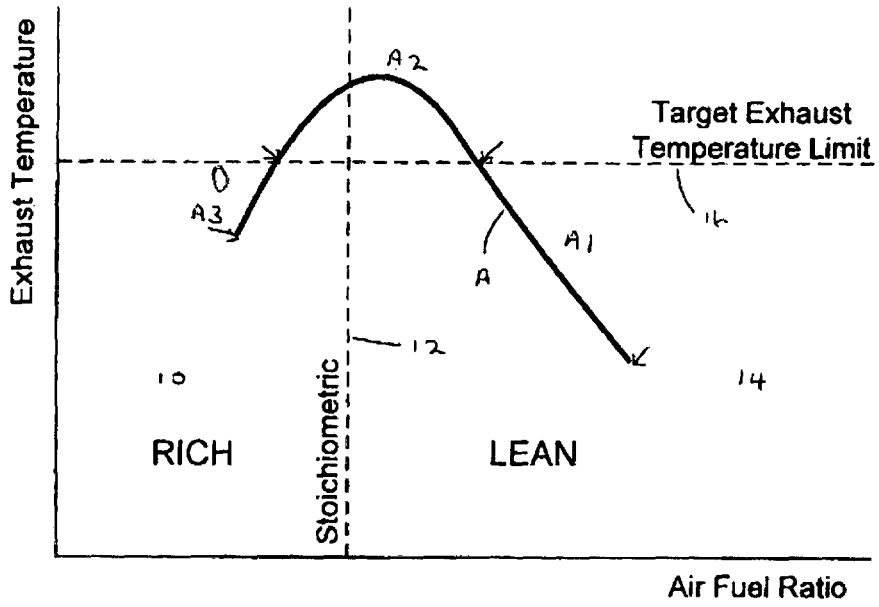
FIG. 1 shows a chart of exhaust gas temperature relative to air fuel ratio for an embodiment of the present invention.

One or more embodiments of the present invention will hereinafter be described with reference to the accompanying figures.

Known methods of operating a UAV to control exhaust gas temperature involve operating the engine at richer than stoichiometric air-fuel ratios to use the excess fuel to cool the exhaust gases.

Whilst successful at reducing exhaust gas temperature to preserve the lightweight metal exhaust outlet from melting, continually using a rich air-fuel ratio leads to poor overall fuel economy and thereby a need to carry excessive fuel load to give the UAV required range and endurance.

The present invention addresses this problem. It has been realised that control of exhaust gas temperature can also be achieved through selective control of the mode of combustion based on required engine load.

According to one or more embodiments of the present invention, when part load is required, engine combustion can be run lean. Under such operating conditions cooling airflow over an air cooled UAV engine at part load can be sufficient to maintain the exhaust gas outlet within temperature operating requirements to prevent the exhaust system melting. When high engine loads are required, such as high engine speed at take off or when climbing, or with a heavy payload, the engine is instead operated with a rich air-fuel ratio. The excess fuel available in the exhaust under these operating conditions acts to cool the exhaust gases passing through the exhaust manifold and system of the UAV.

Thus, instead of operating the UAV engine at a rich air-fuel ratio all of the time, the present invention adopts an excursion into lean air-fuel ratio operating conditions during part load, and transitions to a rich air-fuel ratio for higher engine loads. This fuelling strategy advantageously increases UAV range and/or endurance by improving overall fuel consumption and/or beneficially reduces the maximum amount of fuel required to be carried by the UAV, which can then reduce overall weight of the UAV or allow for increased payload. Risk of heat damage to an aluminium exhaust outlet, such as the engine exhaust manifold, is also alleviated by preventing exhaust gas temperature increasing to the point where the exhaust gas outlet would otherwise melt. As mentioned, this is particularly advantageous when the exhaust gas outlet is made of aluminium which is lightweight but has a relatively low melting point.

Engine management techniques are then used to transition the air-fuel ratio between lean operation and rich operation depending on engine load demand. The transition is preferably made using a measure of engine speed or demanded load (or a combination of both). It will be appreciated that as engine speed increases, the air-fuel ratio increases (and lambda decreases). This is because, as the UAV engine is driving a fixed propeller without pitch control, the engine will operate on a propeller curve. That is, as the engine output power (load) increases, the engine speed will also increase along a profile defined by the propeller design and air density (related to altitude and geographic location).

Demanded load can be derived from operator input. This may include direct measurement of an operator input, such as throttle demand/position reading, or an inlet manifold pressure reading. Direct communication of an operator input, such as an engine speed request or engine load request may alternatively or additionally be used.

Method of transition between lean and rich air-fuel ratio can be through switching with a hysteresis band around the demand load measure. For best engine speed control (torque response) at least one embodiment of the present invention includes control of both fuelling and airflow into the engine. Engine throttle control can be used to effect this, which can be implemented by the engine management system, such as a drive by wire throttle system.

Transition between leaner than stoichiometric air-fuel ratio and richer than stoichiometric air-fuel ratio can be implemented through interpolation over a pre-defined engine speed and load range. This range can be defined in an area where elevated exhaust temperatures are permissible. Such an arrangement does not necessitate use of throttle control by the engine management system. It allows for the throttle to be directly controlled by the operator.

Operating the engine at lean air-fuel ratios has been found to be beneficially achieved by using direct injection fuel systems. Such systems include dual fluid (air assisted direct injection) and single fluid (high pressure direct injection) systems.

DI fuel systems are capable of delivering lean stratified fuel charges which include forming some region within the air-fuel mixture in the combustion chamber which is close enough to stoichiometric to enable the initiation of combustion. Without this region, it may not be possible to initiate combustion for in cylinder air-fuel charges where the overall air fuel ratio is significantly leaner than stoichiometric.

Use of a direct injection fuel system to provide multiple injection events per cycle per cylinder allows for torque and stability management while preserving air-fuel ratios lean enough to maintain the exhaust gas temperature below desired limits.

Use of a direct injection fuel system is also advantageous to control knock when operating lean to maintain low exhaust temperatures. Knock or 'pre-ignition' occurs when the air fuel ratio is too lean and the air-fuel mixture ignites prematurely, which increases temperature. Controlling knock is important in the mid load region (50% to 80% load) where torque requirement necessitates operation at lean air-fuel ratios closer to the onset of knock and exhaust gas temperature limits. Direct injection allows control of residence time of fuel in the cylinder/combustion chamber prior to ignition allowing higher resistance to knock.

Adoption of a dual fuel (air assisted) direct injection fuel system allows heavy fuels to be atomised. At very low temperatures, as experienced by UAVs at high altitudes, heavy fuels, such as JP-5 and JP-8 (jet propellant 5 and 8), become more difficult to deliver into the combustion chamber.

Air assisted direct injection helps to atomise such fuels at very low ambient temperatures, partly because the air is generally warmer as a result of going through the primarily metal air injection system warmed by convection and conduction from the engine, and partly as a result of entraining the fuel in the air through the injection method and injection components. It is envisaged that the present invention is applicable to 2 stroke and 4 stroke engines, and preferably to such engines fuelled by direct injection systems.

FIG. 1 shows plot A of exhaust gas temperature against air-fuel ratio. A richer than stoichiometric region 10 is shown to the left of the dotted 'stoichiometric line' 12, and a lean air-fuel region 14 to the right. A 'target' 16 exhaust gas temperature limit is shown. This limit may vary depending upon various parameters, such as the material the UAV engine exhaust gas outlet is made from, the type of fuel delivery system, the type of fuel etc.

At sufficiently low engine loads, the air-fuel ratio can be maintained in a lean ratio region A1 of the plot in FIG. 1. As demand on the engine causes engine speed and load to increase, the amount of excess air available reduces. The ability to operate lean is reduced and the exhaust gas temperature increases as the mixture becomes richer. In order to obtain the demand power, and keep exhaust temperature below an exhaust gas temperature limit 16, the air-fuel ratio is transitioned to a richer than stoichiometric region A3 in FIG. 1. As engine load and speed demand decreases, the air-fuel ratio can be transitioned back to region A1. A short or momentary excursion through air-fuel ratio region A2 can be maintained sufficiently short as to be insignificant or negligible in affect.

Figure 2:
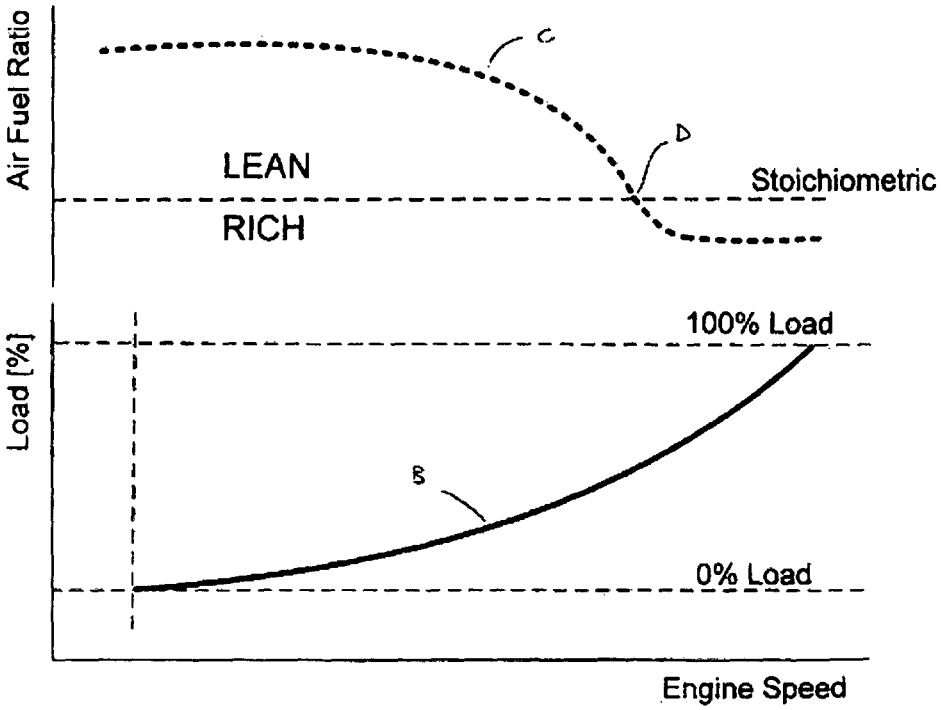
FIG. 2 shows a combined chart of air fuel ratio and load (%) compared to engine speed for an embodiment of the present invention.

The lower plot B in FIG. 2 shows engine load (%) against engine speed. As engine load increases with engine speed, the air-fuel ratio (shown as plot C in the upper chart of FIG. 2 is controlled to transition from leaner to richer than stoichiometric to maintain cooling of the exhaust gases, and thereby reduce the risk of the exhaust outlet melting and also helping to improve fuel economy.

In the embodiment shown in FIG. 2, at approximately 75-80% of maximum engine speed, equating to approximately 50-60% of engine load, the air-fuel ratio transitions across stoichiometric (at point D) into a rich fuel-air ratio region. This transition point D and the slope of the transition plot C at any point can vary depending on the type of engine and engine capacity, payload, fuelling system and type of fuel.

However, according to the present invention, air fuel ratio always transitions to a richer than stoichiometric at sufficiently high engine loads. At lower engine loads (consistent with lower engine speeds) and lower exhaust gas temperature, fuelling is leaner than stoichiometric which allows just natural air cooling to cool the engine and the exhaust gas outlet.

The invention claimed is:

1. A method of controlling exhaust gas temperature of an exhaust system of an unmanned aerial vehicle (UAV) engine during operation, the UAV engine having an engine management system for controlling the operation of the UAV engine, the method including the engine management system controlling the engine to operate with a leaner than stoichiometric air-fuel ratio during low or part engine load conditions, and controlling the exhaust gas temperature to be no higher than a threshold exhaust gas temperature by transitioning the air-fuel ratio to a richer than stoichiometric air-fuel ratio based on a measured, demanded or required increase in engine load or engine speed, or both engine load and engine speed.

2. A method as claimed in claim 1, including the UAV engine utilising direct injection.

3. A method as claimed in claim 2, including the UAV engine utilising dual fluid direct injection.

4. A method as claimed in claim 3, the use of the dual fluid direct injection including injecting heavy fuel.

5. A method as claimed in claim 4, whereby injecting the heavy fuel includes injecting jet propellant (JP).

6. A method as claimed in claim 5, wherein the jet propellant is JP5 or JP8.

7. A method as claimed in claim 2, including, when operating the UAV engine at the leaner than stoichiometric air-fuel ratio, injecting a stratified fuel delivery into at least one combustion chamber of the UAV engine, the stratified fuel delivery including a portion at or close to stoichiometric air-fuel ratio.

8. A method as claimed in claim 2, including providing multiple injection events per cycle per cylinder.

9. A method as claimed in claim 1, including cooling exhaust gas temperature using air cooling at part or low engine load when operating the UAV engine at the lean air-fuel ratio, and cooling exhaust gas temperature at increased or high engine load by transitioning the air-fuel ratio to the richer than stoichiometric ratio.

10. A method as claimed in claim 1, including determining engine load demand, and transitioning air-fuel ratio based on that demand.

11. A method as claimed in claim 10, including determining the engine load demand from one or more operator inputs.

12. A method as claimed in claim 11, the one or more operator inputs including an indication of throttle position or the engine speed requested.

13. A method as claimed in claim 1, including controlling transition between leaner than stoichiometric and richer than stoichiometric air fuel ratios based on exhaust gas temperature over a predefined range or ranges of engine speed or engine load, or both engine speed and engine load.

14. A method as claimed in claim 13, including utilising a look up table or algorithm using engine speed or engine load demand to determine a required said air-fuel ratio to maintain the exhaust gas temperature below a desired value or within a desired temperature range.

15. A method as claimed in claim 1, including determining a temperature value relating to the exhaust gas temperature, and using that determined temperature value to transition the air-fuel ratio towards a richer air-fuel ratio to reduce the exhaust gas temperature, maintain exhaust gas temperature at a desired level or slow down the rate of increase of exhaust gas temperature.

16. A method as claimed in claim 15, including preventing exhaust gas temperature exceeding the threshold temperature by richening the air-fuel ratio.

17. A UAV engine controlled according to the method of claim 1.

18. A method as claimed in claim 1, wherein the air-fuel ratio is varied as a function of exhaust gas temperature by feedback whereby rate of increase in the air-fuel ratio is reduced or stopped as detected exhaust gas temperature reduces with richening air-fuel ratio.

19. A method as claimed in claim 18, whereby the rate of increase in air-fuel ratio is reduced or stopped to control the exhaust gas temperature to be no higher than the threshold value or within a required band of air-fuel ratio.

* * * * *